US008171857B2

(12) United States Patent
Bischofberger

(10) Patent No.: US 8,171,857 B2
(45) Date of Patent: May 8, 2012

(54) INSTALLATION FOR THE DOWNWARD TRANSPORT OF PERSONS FROM A MOUNTAIN STATION TO A VALLEY STATION

(75) Inventor: Markus Bischofberger, Bezau (AT)

(73) Assignee: Innova Patent GmbH, Wolfurt (AT)

( * ) Notice: Subject to any disclaimer, the term of this patent is extended or adjusted under 35 U.S.C. 154(b) by 200 days.

(21) Appl. No.: 12/476,384

(22) Filed: Jun. 2, 2009

(65) Prior Publication Data

US 2009/0293757 A1 Dec. 3, 2009

(30) Foreign Application Priority Data

Jun. 2, 2008 (AT) ..... A 885/2008

(51) Int. Cl.
*B61B 12/04* (2006.01)

(52) U.S. Cl. ..... 104/123; 104/124; 104/112

(58) Field of Classification Search ..... 104/123, 104/87, 89, 91, 93, 112, 113, 115, 124, 173.1, 104/180
See application file for complete search history.

(56) References Cited

U.S. PATENT DOCUMENTS

| | | | | |
|---|---|---|---|---|
| 3,753,406 | A | 8/1973 | Müller | |
| 5,127,338 | A * | 7/1992 | Flux | 105/151 |
| 6,571,716 | B2 * | 6/2003 | Albrich | 104/123 |
| 6,644,207 | B2 * | 11/2003 | Albrich | 104/112 |
| 6,655,641 | B2 * | 12/2003 | Sherman et al. | 248/58 |
| 2002/0124762 | A1 * | 9/2002 | Albrich | 104/112 |
| 2002/0124763 | A1 * | 9/2002 | Albrich | 104/112 |
| 2008/0229967 | A1 * | 9/2008 | Lins et al. | 104/173.1 |
| 2009/0293757 | A1 * | 12/2009 | Bischofberger | 104/123 |
| 2010/0107919 | A1 * | 5/2010 | Perakis | 104/112 |

FOREIGN PATENT DOCUMENTS

| | | | |
|---|---|---|---|
| AT | 410306 | B | 3/2003 |
| DE | 2149871 | A1 | 4/1972 |
| DE | 2723543 | B1 | 12/1978 |
| DE | 2919318 | A1 | 12/1980 |
| DE | 1238879 | A2 | 9/2002 |
| NZ | 517305 | A | 6/2002 |

OTHER PUBLICATIONS

Austrian Search Report dated May 6, 2009.
New Zealand Examination Report dated May 21, 2009.

* cited by examiner

*Primary Examiner* — S. Joseph Morano
*Assistant Examiner* — Jason C Smith
(74) *Attorney, Agent, or Firm* — Laurence A. Greenberg; Werner H. Stemer; Ralph E. Locher

(57) ABSTRACT

An installation for carrying individuals down from a mountain station into a valley station has a running rail which is fastened on a supporting cable at a distance from the ground. The running rail contains a multiplicity of sub-rails connected to one another at joints and along which carriages can be displaced. In the region of the joints, the sub-rails are elevated in relation to their central region, and are preferably curved such that their curvature profile creates the elevation.

14 Claims, 6 Drawing Sheets

INSTALLATION FOR THE DOWNWARD TRANSPORT OF PERSONS FROM A MOUNTAIN STATION TO A VALLEY STATION

CROSS-REFERENCE TO RELATED APPLICATION

This application claims the priority, under 35 U.S.C. §119, of Austrian application A 885/2008, filed Jun. 2, 2008; the prior application is herewith incorporated by reference in its entirety.

BACKGROUND OF THE INVENTION

FIELD OF THE INVENTION

The invention relates to an installation for carrying individuals down from a mountain station into a valley station, having a running rail which is fastened on a supporting cable at a distance from the ground. The running rail includes a multiplicity of sub-rails connected to one another at joints and along which carriages can be displaced.

Such an installation is known from Austrian patent AT 410 306 B, corresponding to U.S. Pat. No. 6,571,716. The travelling speed of the carriages on the running rail is, in some cases, 70 km/h or more, as a result of which problems arise in respect of the smoothness of running of the carriages at the joints connecting the sub-rails, or the transitions between the sub-rails, and the jolting which occurs also gives rise to problems relating to wear.

SUMMARY OF THE INVENTION

It is accordingly an object of the invention to provide an installation for the downward transport of persons from a mountain station to a valley station that overcomes the above-mentioned disadvantages of the prior art devices of this general type.

With the foregoing and other objects in view there is provided, in accordance with the invention, an installation for carrying individuals down from a mountain station into a valley station. The installation includes a supporting rail and a running rail fastened on the supporting rail at a distance from ground. The running rail contains a multiplicity of sub-rails connected to one another at joints and along which carriages can be displaced, and in a region of the joints, the sub-rails are elevated in relation to a central region of the sub-rails.

The object is achieved in the case of an installation of the generic type in that, in the region of the joints, sub-rails are elevated in relation to their central region.

Since the sub-rails, in the case of the installation according to the invention, are suspended from a cable, the sub-rails dip under the weight of the carriages occupied by one or more individuals. As a carriage approaches the end of a sub-rail, at which the latter is connected to a following sub-rail via a joint, the sub-rail dips in its end region, and the following sub-rail dips at its starting region, under the weight of the carriage, in which case the prior-art sub-rails and in particular their running surfaces, along which the carriages roll, are no longer aligned entirely rectilinearly in relation to one another and a slight V-shaped dip appears in the connecting region.

The invention compensates for this dip in that the sub-rails are elevated in the region of the joints by the extent of the dip which is to be expected. In a non-loaded state of the running rail or of the individual sub-rails, this results in that, in the transition region from one sub-rail to the next, the sub-rails are elevated in relation to the ideal rectilinear profile (or curved profile where the path is curved) and this elevation corresponds to the extent of the average dip which is to be expected as a result of the weight of the carriages and of the individual(s) therein, so that ultimately, when a carriage travels over them, the sub-rails are in ideal rectilinear alignment in relation to one another (or in curved alignment where the path is curved).

Even now it would be possible, in principle, to produce rectilinear sub-rails, or sub-rails which are curved in accordance with a curved profile, and to elevate these at their starting and end regions by additional integrally formed portions, it is preferred, within the context of the invention, if the sub-rails are curved such that their curvature profile creates the elevation. In this case, use can be made of sub-rails which have a continuous profile and only have to be curved in accordance with the path curves which may be required and with the elevation at the starting and end regions of the sub-rails.

In the case of the invention, abutting sub-rails, or the running surfaces thereof, are thus inclined in relation to one another in the non-loaded state at an angle other than 180°. The extent of these angle deviations depends on a number of factors, e.g. the length of the sub-rails, the span of the cable between two supports, the sagging of the cable, the weight of the carriages and the number of individuals therein, etc. It is usually the case that the angle at which adjacent sub-rails, or the running surfaces thereof, are inclined in relation to one another in the region of the joints is between 175° and 179°, preferably between 176° and 178°. In some cases, however, it is, of course, also possible for this angle to be higher or lower.

In order to make it possible for the sub-rails to dip, or in order to allow them to dip, when a carriage travels over a joint, it is preferred, in the case of the invention, if a wedge-shaped gap is arranged at a joint between two sub-rails.

The two sub-rails may be connected to one another via a joint axis. The joint axis may be arranged in the top region of the sub-rails, approximately halfway up the same or in the bottom region of the sub-rails.

Within the context of the invention it would basically be possible, for example, for the joint axis to be arranged in the top region and for the gap to be arranged beneath the joint axis in the loaded state of the joint. In the non-loaded state of the joint, it would thus be possible for no gap to be present, or for only a small gap to be present, and for the gap then to be created, or to increase, when the sub-rails dip in the region of the joint as a carriage travels over the same.

It is preferred, within the context of the invention, however if the joint axis is arranged approximately halfway up the sub-rails and, furthermore, if the wedge-shaped gap is arranged above the joint axis in the non-loaded state of the joint. This gap closes partially or completely when a carriage travels over the joint.

In the case of the invention, it is further preferred if, in the region of the joints, a damping element is arranged on end surfaces of the sub-rails. If the joint axis is arranged approximately halfway up the sub-rails, and the wedge-shaped gap is arranged above the joint axis in the non-loaded state of the joint, the damping element is preferably arranged above the joint axis. The damping element may be arranged such that it constantly damps the pivoting movement of the sub-rails, or preferably such that it damps the movement of the sub-rails only at the end of the dipping movement, that is to say just before the gap is completely closed or the sub-rails strike against one another.

Within the context of the invention, it is possible, in the region of the joints, for the sub-rails to be suspended from the cable by rail shoes, via links. It is preferred in this context if, in the region of a joint, two sub-rails connected to one another at a joint are suspended from a common rail shoe, via a respective link. This embodiment gives the advantage of straightforward and statically reliable installation.

In a development of the invention, it may also be provided that a rail shoe has two or more optional bearing locations for a link. This embodiment gives the further advantage that the different angles which the links can thus assume make it possible to set different loading ratios for the force transmission between the rail shoe and the sub-rails connected to one another at a joint.

Other features which are considered as characteristic for the invention are set forth in the appended claims.

Although the invention is illustrated and described herein as embodied in an installation for the downward transport of persons from a mountain station to a valley station, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
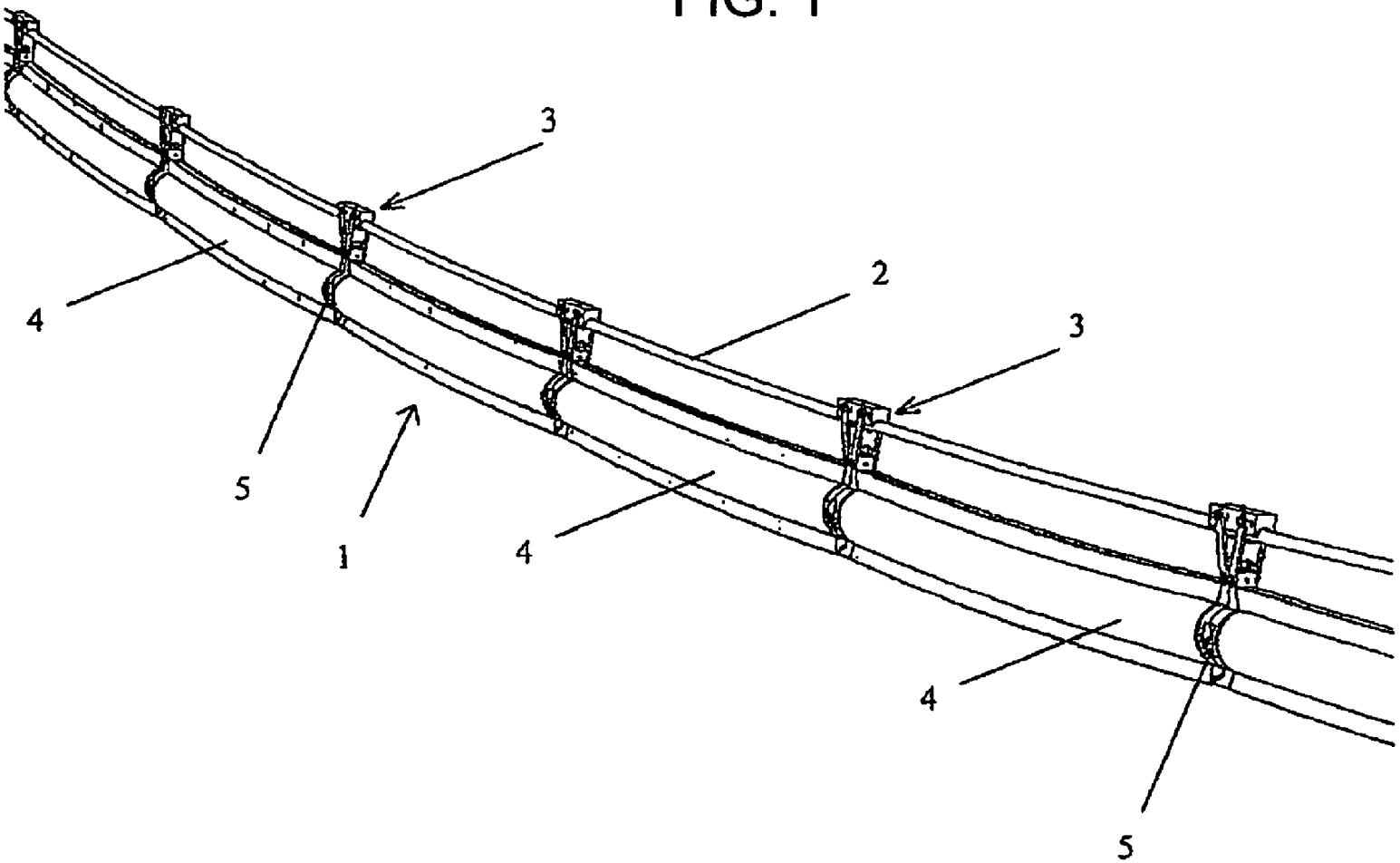
FIG. 1 is a diagrammatic, perspective view of a part of an installation according to the invention.

Referring now to the figures of the drawing in detail and first, particularly, to FIG. 1 thereof, there is shown part of an installation which is intended for carrying individuals down from a mountain station into a valley station and in which a running rail 1 is suspended from a supporting cable 2 via a suspension device 3. The installation can be configured generally as is known per se from the prior art, for example from Austrian patent AT 410 306 B. Therefore the supporting cable 2 is tensioned between supports, stationary points of the landscape or the like, it being possible to use a single supporting cable 2 or a plurality of supporting cables 2 arranged one behind the other in the direction of travel. Traveling along the running rail 1 are non-illustrated carriages which may be in the form of cars, chairs, gondolas or the like and in which individuals or passengers sit, lie or stand in order to be carried down from a mountain station to a valley station, preferably driven by gravitational force. Since the configuration of the mountain station and valley station, of the supports or the like and of the carriages have no particular bearing on the invention, they have not been illustrated in the drawings and, in addition, will not be described in any more detail hereinbelow in the description.

Figure 2:
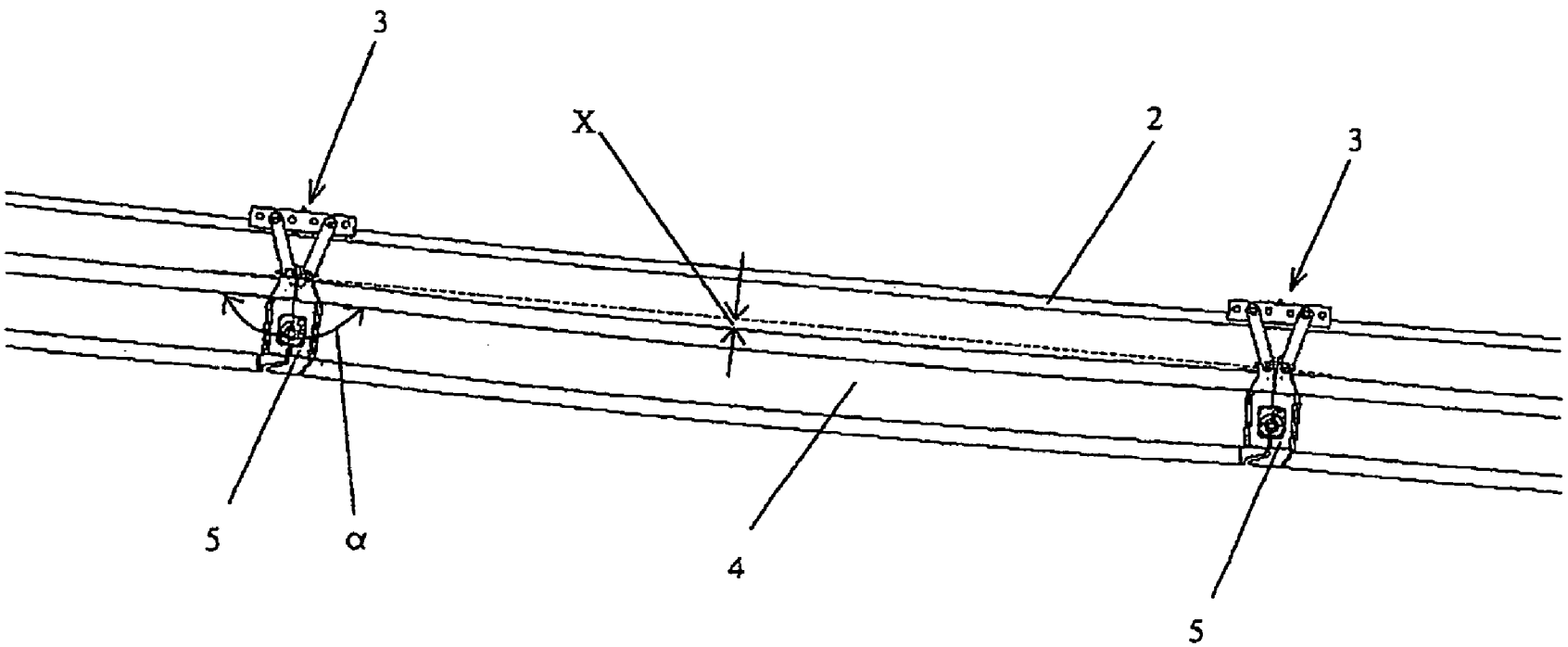
FIG. 2 is an enlarged detail of the part of the installation from FIG. 1.

The running rail 1 contains sub-rails 4 which are connected to one another at joints 5. The sub-rails 4, as can best be seen in FIG. 2, are curved such that they sag to some extent in their central region and, in the region of the joints, are elevated in relation to the central region. The extent of this elevation is designated by X in FIG. 2. If a carriage travels over a sub-rail 4 and is located precisely in the central region thereof, its weight is distributed approximately equally to the supporting cable 2 via the two suspension devices 3 at the start and at the end of the sub-rail 4. If, however, the carriage is located in the region of a joint 5, its weight is transmitted to the supporting cable 2 only via a single suspension device 3, in which case the ends of the two sub-rails 4 connected to one another at the joint 5 dip to a lower level than in the case described above, in which the carriage is located in the central region of a sub-rail 4.

The bending of the sub-rails 4 causes two adjacent sub-rails 4 to strike against one another at a joint 5 at an angle $\alpha$ of less than 180°, 177° in the exemplary embodiment illustrated. The angle $\alpha$ is selected such that in the case of the given static and dynamic boundary conditions, e.g. the load-bearing capacity and/or elasticity of the supporting cable 2, the distance between two supports and the weight of a carriage, it tends toward 180° when the carriage travels over the joint 5. A following sub-rail 4 is then in precise alignment with a preceding sub-rail 4, and this therefore allows a carriage to travel over a joint 5 without any jolting. At relatively high traveling speeds, this not only increases the comfort of the passengers to a considerable extent, but also significantly reduces the wear to the sub-rails 4 and to the joints 5 and the carriages.

In the exemplary embodiment illustrated, the sub-rails 4 are curved continuously over their entire length. However, the curvature may also be discontinuous, that is to say the radius of curvature is greater in the central region and decreases, continuously or discontinuously, in the direction of the ends of the sub-rails 4. It is likewise possible for the sub-rails 4 to be rectilinear in the central region and to be curved in the direction of the ends. The curvature which has just been mentioned is the curvature which creates the elevation of the sub-rails 4 according to the invention, this elevation compensating for the dip which occurs when a carriage travels over the joints. Independently of this, it is, of course, possible for the sub-rails 4 to be curved in addition, in order for curves to be created along the path of the running rail 1.

Figure 3:
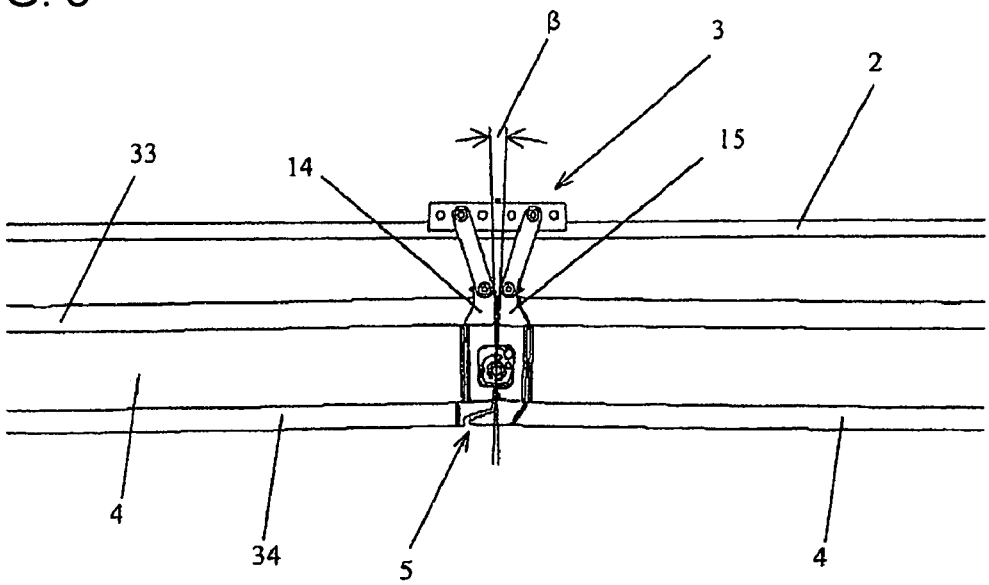
FIG. 3 is a front-elevational view of a joint connecting two sub-rails, in a non-loaded state.
Figure 5:
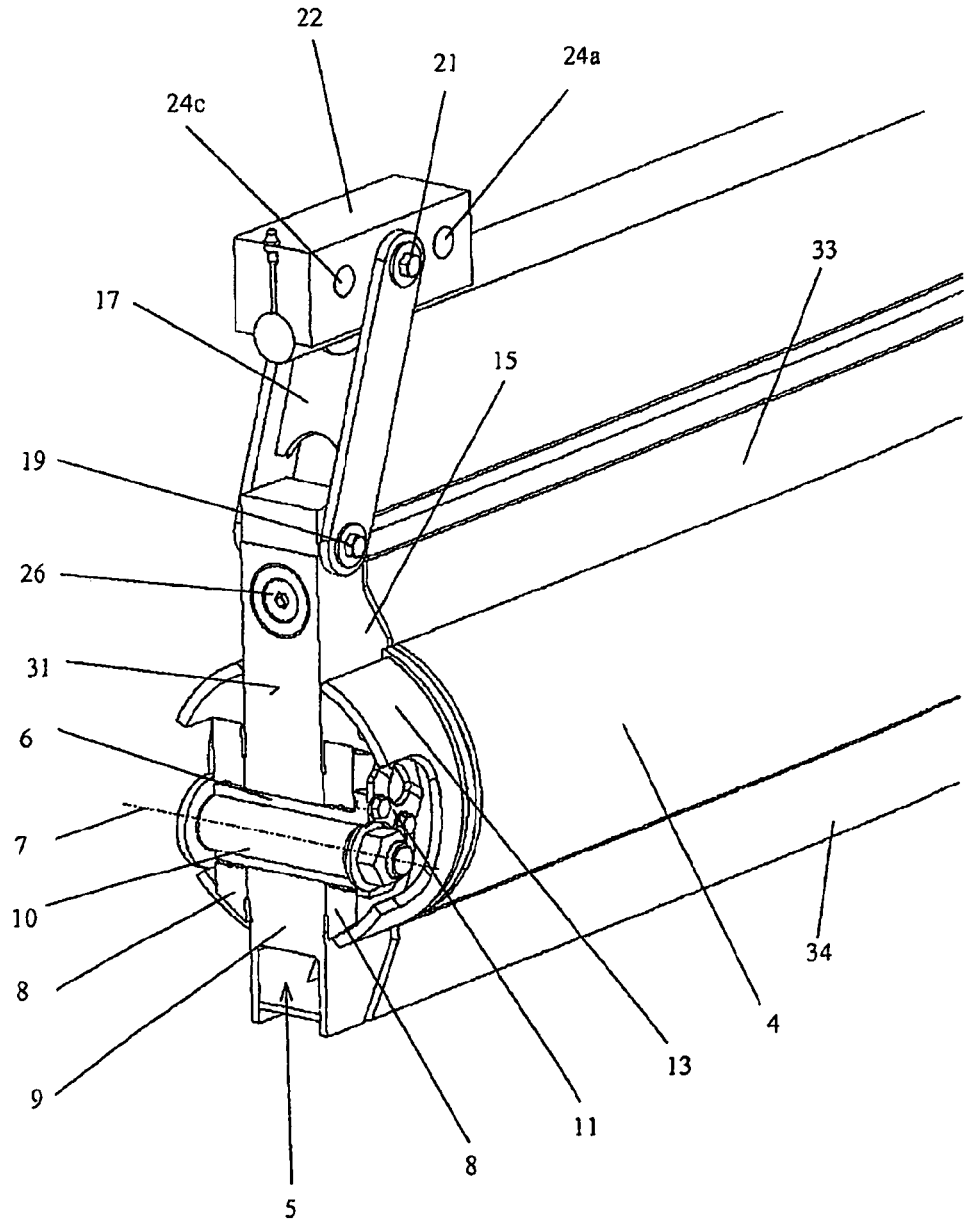
FIG. 5 is a diagrammatic, perspective view, on an enlarged scale, of part of the joint with a damping element.

FIG. 3 illustrates, on an enlarged scale, a joint location in the non-loaded state, two sub-rails 4 here being connected to one another at a joint 5 and being suspended from the supporting cable 2 via the suspension device 3. The joint 5, which is illustrated in section, on an enlarged scale, in FIG. 5, has a hollow bolt 6, which defines a joint axis 7. The hollow bolt 6 connects two joint parts 8 and 9, which are each connected to a sub-rail 4. The hollow bolt 6 is secured against displacement with the aid of a securing bolt 10 and against rotation with the aid of a rotation-prevention device 11. The joint parts 8 and 9 are accommodated in circular-cylindrical end caps 12, 13 which close the tubes which form the sub-rails 4, these tubes, in the exemplary embodiment illustrated, being circular-cylindrical.

The outer circumference of the tubes which form the sub-rails 4 forms the running surface for then non-illustrated carriages, which roll along these running surfaces via running rollers. The external diameter of the end caps 12, 13 is equal to the external diameter of the tubes which form the sub-rails 4, and this therefore makes it possible for a carriage to travel over the joint 5 without any jolting.

On their top side, the two joint parts 8, 9 have extensions 14, 15, on which links 16, 17 are mounted in a pivotable manner in bearings 18, 19. At the opposite ends, the links 16, 17 are mounted on a rail shoe 22 via joint pins 20, 21. In the exemplary embodiment illustrated, the rail shoe 22 has, for each link 16, 17, in each case three holes 23*a*, 23*b*, 23*c* and 24*a*, 24*b*, 24*c*, in which the joint pins 20, 21 can optionally be inserted. An appropriate selection of the holes makes it possible to vary the angle at which the links 16, 17 are oriented, as a result of which it is also possible for the dissipation of forces to be better adapted to the respective conditions.

Figure 6:
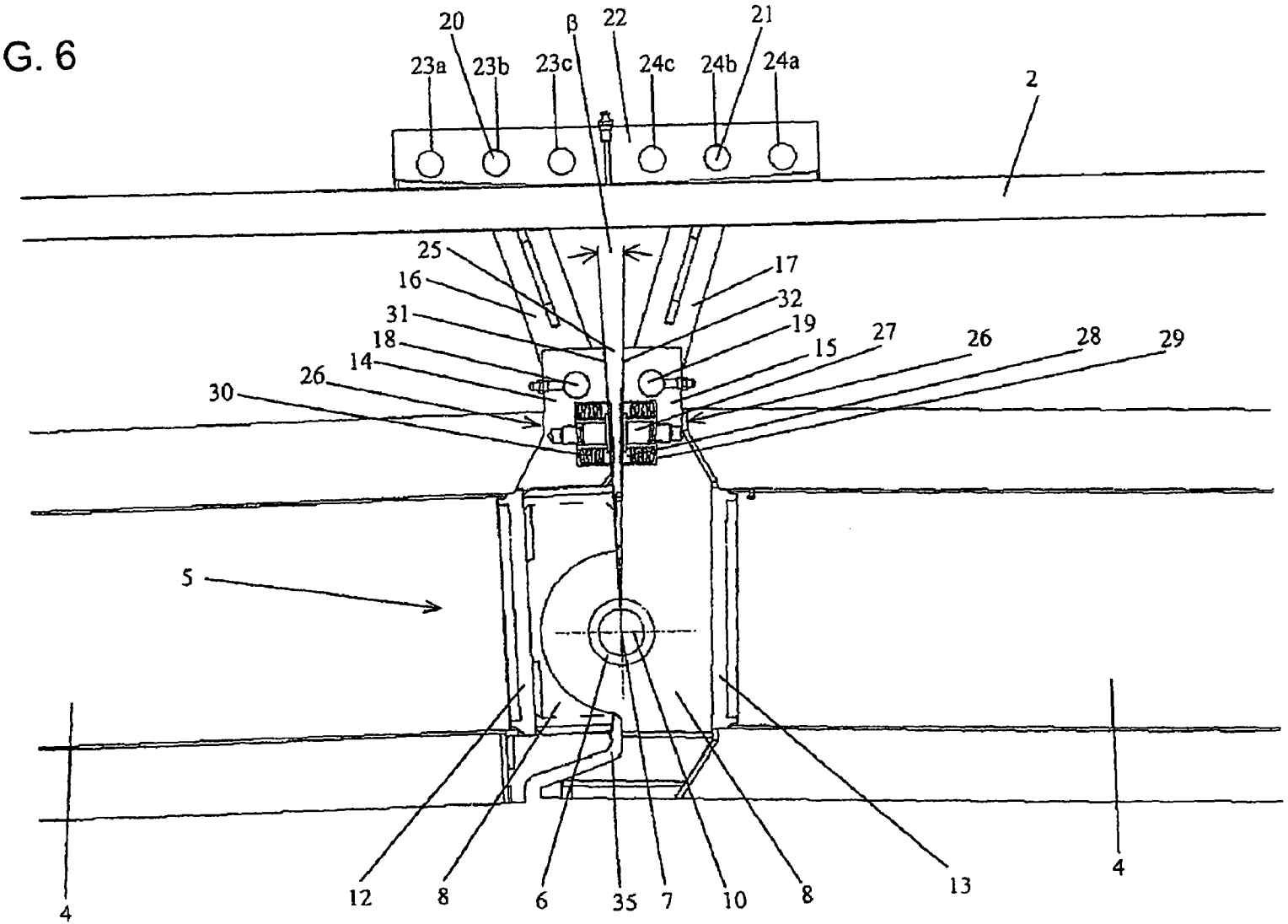
FIG. 6 is a sectional view of the joint from FIG. 5 in the non-loaded state.

As can best be seen in FIGS. 3 and 6, the two joint parts 8 and 9 and the extensions 14, 15 thereof are separated from one another by a wedge-shaped gap 25 above the joint axis 7 in the non-loaded state. The wedge angle β of this gap 25 is approximately equal to the angle 180°-α, at which the orientation of the ends of the sub-rails 4, or of the running surfaces thereof, deviates from the straight position.

Figure 4:
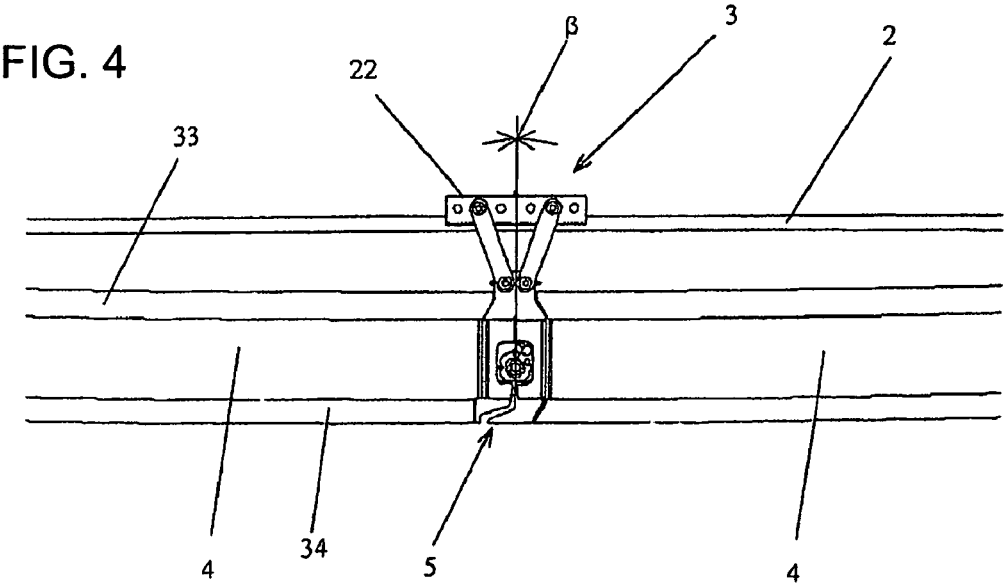
FIG. 4 is a front-elevational view of the joint from FIG. 3 in the loaded state.
Figure 7:
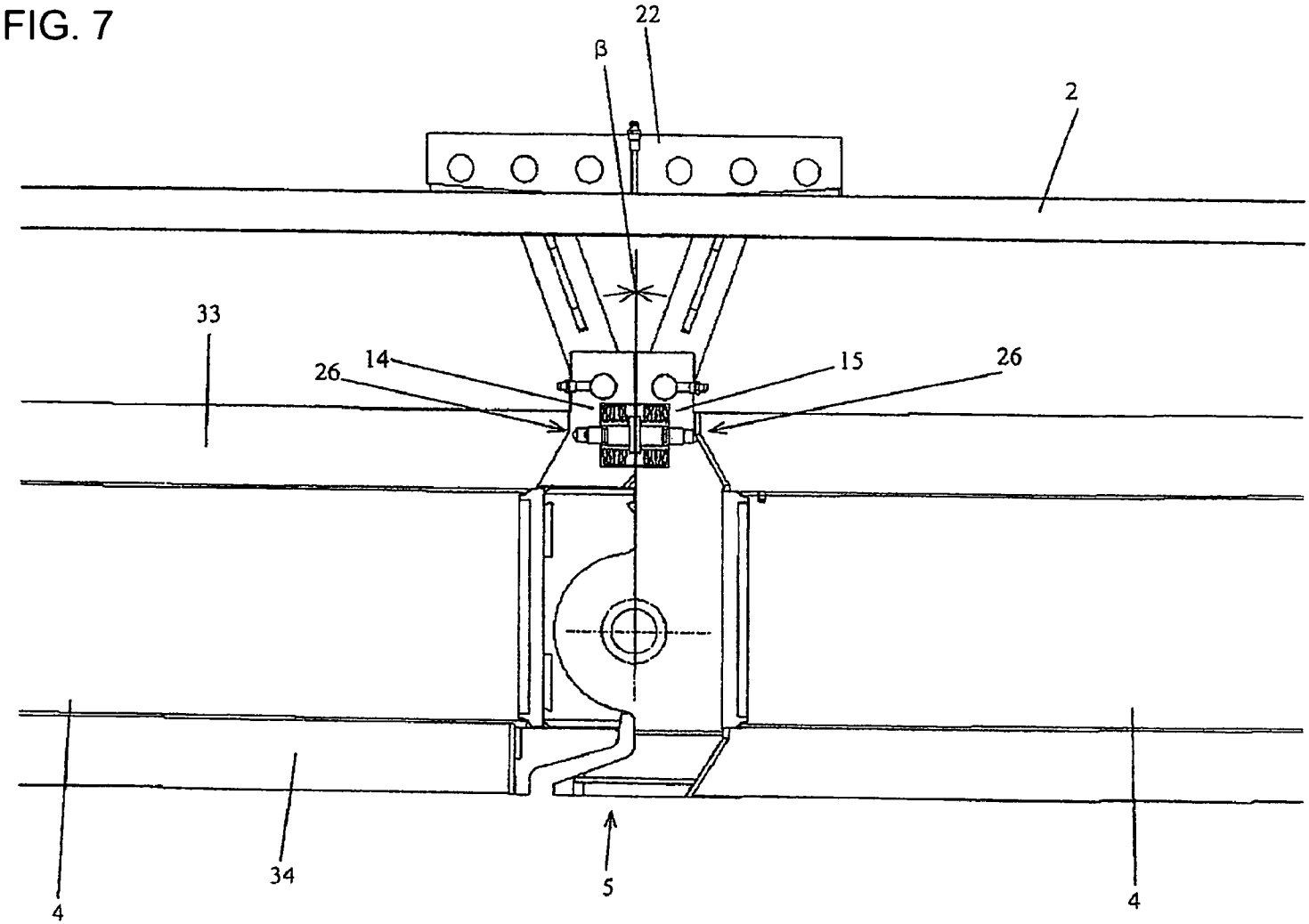
FIG. 7 is a sectional view of the joint from FIG. 5 in the loaded state.

If a carriage travels over a joint 5, the sagging of the cable 2 increases in this region, and therefore the ends of the sub-rails 4 dip at the joint 5, as a result of which the wedge-shaped gap 25 is closed. This position of the joint is illustrated in FIGS. 4 and 7. In this position, those ends of the sub-rails 4 which are connected by the joint 5 are in precise alignment in relation to one another, and the carriage can therefore travel over the joint 5 without any jolting.

Since the two joint parts 8, 9 and/or the extensions 14, 15 thereof strike against one another as the carriage travels over the joint, it is advantageous for this striking action to be damped, for which reason the invention provides damping elements 26 in the extensions 14, 15.

In the exemplary embodiment illustrated, the damping elements 26 have pins 27 with widened heads 28, which are accommodated in holes 29 in the extensions 15 and are supported on the base of the holes 29 via cup springs 30. The heads 28 project only to a slight extent beyond the end surfaces 31, 32 of the extensions 14, 15, and the damping elements 26 therefore take effect just shortly before the extensions 14, 15 strike against one another.

The joint parts 8, 9 are also separated beneath the joint axis 7 by a gap 35, and the latter also allows the joints 5 to move freely in the upward direction. This is advantageous since, as carriages descend along the running rail 1, the entire running rail 1 can thus swing freely upward and downward without subjecting the joint 5 to mechanical loading as a result.

Additional rails 33, 34 are arranged on the top side and underside of the tubes of the sub-rails 4, these tubes forming the running surfaces, and the additional rails, on the one hand increase the flexural rigidity of the sub-rails 4 and, on the other hand, serve as guides for the running-gear mechanisms of the carriages in order to limit movement of the carriages to and fro about the longitudinal axis of the sub-rails 4, or to prevent this movement altogether.

The invention claimed is:

1. An installation for carrying carriages having individuals down from a mountain station into a valley station, the installation comprising: suspension devices; a supporting cable; and a running rail fastened on said supporting cable at a distance from ground, said running rail containing a multiplicity of sub-rails connected to one another at joints and along which carriages can be displaced, and in a region of said joints, said sub-rails are elevated in relation to a central region of said sub-rails, and in a transition region from one of said sub-rails to a next of said sub-rails, said sub-rails are elevated, in a non-loaded state, in relation to an ideal rectilinear profile and the elevation corresponding to an extent of an average dip which is to be expected as a result of a weight of the carriages and of the individuals in the carriages.

2. The installation according to claim 1, wherein said sub-rails are curved such that their curvature profile creates an elevation.

3. The installation according to claim 2, wherein adjacent ones of said sub-rails are inclined in relation to one another in said region of said joints at an angle which is between 176° and 178°.

4. The installation according to claim 2, wherein adjacent ones of said sub-rails are inclined in relation to one another in said region of said joints at an angle which is between 175° and 179°.

5. The installation according to claim 1, wherein defined at each of said joints between two of said sub-rails is a wedge-shaped gap.

6. The installation according to claim 5, wherein:
said joints each have a joint axis; and
said wedge-shaped gap is formed above said joint axis in a non-loaded state of said joint.

7. The installation according to claim 6, wherein said joint axis is disposed halfway up said sub-rails.

8. The installation according to claim 7, wherein said wedge-shaped gap is disposed beneath said joint axis in a loaded state of said joint.

9. The installation according to claim 5, wherein:
said joints each have a joint axis; and
said wedge-shaped gap between said sub-rails is formed beneath said joint axis.

10. The installation according to claim 9, wherein said joint axis is disposed halfway up said sub-rails.

11. The installation according to claim 1,
further comprising a damping element;
said joints each have a joint axis; and
wherein said sub-rails have end surfaces; and
wherein in said region of said joints, said damping element is disposed on said end surfaces of said sub-rails.

12. The installation according to claim 11, wherein said damping element is disposed above said joint axis.

13. An installation for carrying individuals down from a mountain station into a valley station, the installation comprising:
a supporting cable;
a running rail fastened on said supporting cable at a distance from ground, said running rail containing a multiplicity of sub-rails connected to one another at joints and along which carriages can be displaced, and in a region of said joints, said sub-rails are elevated in relation to a central region of said sub-rails;
rail shoes; and
links, in said region of said joints, said sub-rails are suspended from said supporting cable by said rail shoes, via said links, in said region of said joint, two of said sub-rails connected to one another at said joint are suspended from a common rail shoe of said rail shoes, via a respective one of said links.

14. The installation according to claim 13, wherein each of said rail shoes has at least two bearing locations for one of said links.

* * * * *